United States Patent [19]

Dauthuille

[11] 4,052,962

[45] Oct. 11, 1977

[54] ECONOMIZER DEVICE FOR EXPLOITING THE THERMAL OUTPUT OF HEATING INSTALLATIONS

[76] Inventor: Roger Dauthuille, 24 rue Romain Rooland, 93410 Vaujours, France

[21] Appl. No.: 645,468

[22] Filed: Dec. 30, 1975

[51] Int. Cl.[2] ..... F22B 7/00; F22B 33/02

[52] U.S. Cl. ..... 122/20 A; 122/165

[58] Field of Search ..... 122/155, 156, 165, 20 A, 122/421

[56] References Cited

U.S. PATENT DOCUMENTS

| | | | |
|---|---|---|---|
| 1,841,030 | 1/1932 | Hofmann | 122/165 |
| 1,932,793 | 10/1933 | Lough | 122/20 A |
| 2,065,994 | 12/1936 | Bork | 122/20 A |
| 2,088,647 | 8/1937 | Gilroy | 122/20 A |
| 2,223,108 | 11/1940 | Jackson | 122/20 A |

*Primary Examiner*—Kenneth W. Sprague

[57] ABSTRACT

An economizer device for fully exploiting the thermal output of central heating installations for heating fluids that incorporates a source of heat herein called "heating fluid" and a source of fluid circulating between a cold zone and a warm zone, herein called "heated fluid," a conduit leading the heated fluid coming from the cold zone into a transfer chamber containing the heating fluid to store there a portion of the thermal energy of this heating fluid and to transfer it to the warm zone. The device is characterized in that the maximum proportion of thermal energy of the heating fluid is removed, before the latter leaves the transfer chamber, by storing this energy by means of appropriate elements disposed in the chamber, this stored energy being restored to the heated fluid either in the chamber itself or immediately the heated fluid leaves the chamber in order to pass into the warm zone.

1 Claim, 5 Drawing Figures

ECONOMIZER DEVICE FOR EXPLOITING THE THERMAL OUTPUT OF HEATING INSTALLATIONS

The present invention concerns an arrangement applicable to installations comprising a source of heat, here designated by "heating fluid" and a source of fluid circulating between a cold zone and a warm zone, designated here by "heated fluid," a conduit leading the heated fluid coming from the cold zone to traverse an enclosure containing the heating fluid so as to store there a portion of the thermal energy of the heating fluid and transferring it to the warm zone.

Such an installation can function with fluids of all kinds, gaseous or liquid, namely air, water, air charged with gas arising from the combustion of hydrocarbons, water vapour or any other fluid used in industry. The means of heating the heating fluid can be physical-chemical such as the combustion of carbon, wood or hydrocarbons, or essentially physical such as electrical, solar, atomic or other energy.

In other words, the invention provides an arrangement of a general character whatever the nature of the two fluids, the means of initially heating the heating fluid, the use of the heated fluid, and more generally still the nature of the installation which can for example be an industrial or domestic heating boiler or a system for preheating fuel in the motor or other type of installation available in industry.

Indeed it is known in all these installations that the major problem is that of thermal output, that is to say the use of the thermal energy of the heating fluid to heat the heated fluid. There is always transfer of this energy in the aforesaid enclosure but never wholly, and it is precisely the ratio between the transferred energy and the saved energy by the heated fluid that one seeks to maximise by different means.

It is manifest that as long as the heating fluid leaves the installation at a temperature higher than that of the cold zone there is a loss of energy so that, on the whole, the solutions already advocated have consisted in using the heating fluid already partially cooled at its exit from the installation to preheat the heated fluid before introducing it into the transfer chamber.

Nevertheless there occurs a simple recuperation whereof the output is always mediocre, the energy of the heating fluid being wasted since this fluid has left the chamber while its source of heat continues to function fully.

The problem which existed was thus either to conserve the same degree of thermal transfer by diminishing the consumption of the source of heat by the heating fluid or to conserve this consumption but by increasing the degree of thermal transfer, or in practice both.

With this in view, the invention consists in providing an installation as specified above so as to deduct, remove or actually exploit the maximum proportion of thermal energy from the heating fluid before the latter leaves the transfer chamber by storing this energy in appropriate elements disposed in the chamber and to restore this stored energy to the heated fluid either in the chamber itself or immediately upon the heated fluid leaving the chamber on its passage to the heated zone.

As has been stated above, thanks to this arrangement, it is possible either to increase the temperature of the heated fluid sent to the heated zone without modifying the source of heat for the heating fluid, or by diminishing the speed or consumption characteristics of this source by obtaining the same temperature of the heated fluid or preferably obtaining the benefit of both of these advantages at the same time.

In practice the elements for storing the thermal energy consist of masses of refractory material which are disposed in the chamber of thermal transfer in the path of the heating fluid beyond the conduit by which the heated fluid traverses this chamber in such a way that the heating fluid transfers its thermal energy in a first stage to the heated fluid in the usual manner, and then in a second stage to the refractory elements which store the same as a function of their thermal capacity which depends on the nature of the material and the quantity used.

Moreover there is provided means for the progressive recuperation of this stored thermal energy during functioning of the installation and later, these means consisting of a secondary conduit for the heated fluid (the usual conduit being considered the primary conduit) branching off from the primary conduit and traversing the masses of refractory elements in such a way that the heated fluid passing along this secondary conduit recuperates the thermal energy accumulated in the elements and rejoins the exit of the primary conduit at the entry of the heated zone.

The energy of the heating source for the heating fluid is thus recovered and exploited almost the wholly in the aforesaid chamber, which assures the maximum degree of recuperation. One can show experimentally that this recovery increases the thermal output of an entire series of installations by between 25 and 35%, and moreover one can obtain an economy in energy of the same order.

It should be noted in passing that this arrangement can be applied not only to new installations but to already existing installations, the cost of modification being relatively minimal. One can with this regard compare such an arrangement with an energy conserving arrangement whereof the utility appears considerable.

Thus it should equally be noted that this arrangement is not a substitute for arrangements previously provided for the same purpose and mentioned hereinbefore but is an adjunct thereto. It is situated in the interior of the thermal transfer chamber while the prior-art arrangements are in general situated on the exterior.

As an example illustrating the invention and not being limitative there is now described the application of the invention to a central heating boiler in which a conduit of water is heated by the combustion gas of a fuel burning appliance.

In such a boiler a burner of known type feeds into a combustion chamber jet of combustion fuel atomized in the air, the latter being thus charged with the heated gas, traversing the chamber from bottom to top, to be evacuated eventually by a chimney.

On its passage this heated mixture which constitutes herein the heating fluid sweeps a transverse conduit of appropriate length which comes from a reservoir of cold water situated at the exterior of the boiler and which at the exit of the boiler distributes warm water to the locations of use. The reservoir constitutes the cold zone, the water constitutes the heated fluid, and the points of use constitute the warm zone.

This type of boiler is quite usual and it is clear that the simple sweeping across the conduit by the heated gas only assures a very slight thermal transfer which involves a substantial consumption of fuel to attain and maintain the desired temperature of the water. Besides with interruption of the functioning of the burner the water ceases to be heated in the conduit, and the heated zone cools rapidly.

According to the invention this conduit has branches in the form of secondary metallic conduits equipped with metallic fins of appropriate length and around which are moulded masses of refractory material, itself already known for its considerable thermal capacity. The branching is disposed in the upper portion of the chamber, not used until now, above the principal conduit. One can circulate water from the reservoir in this branching simultaneously with circulation in the principal conduit due to valves or gates mounted at the ends.

To start up the installation the valves or gates are closed and the heated gas travels from the bottom to the top, transferring the heat on the one hand to the water circulating in the principal conduit and in like manner, and on the other hand, to the refractory elements consequently to the vanes of the branching. When these elements have stored a sufficient quantity of heat the valves or gates of the branching are opened and the water which circulates there recovers slowly the stored heat in the refractory material and adds it to that already transferred to the water coming from the principal conduit.

Consequently the functioning of the installation is established as follows:

one maintains the same type of burner and/or the same output of fuel, and it is possible to attain a temperature and/or an output greater than the water of distribution;

or else one can contain the same temperature and/or the same output of this water but one can then either use a smaller burner or reduce the output of both;

or else one can combine these advantages and economies.

Besides, even with the burner stopped the refractory masses progressively restore the heat which has been accumulated and the water of the secondary circuit is heated during a certain time.

One can thus envisage cycles of operation with burner stoppages ensuring a constant temperature.

The numerous measures applied to a boiler equipped with a secondary circuit as described have led to the conclusion that on the whole and with the variable elements maintained constant the energy economy resulting from this arrangement is of the order of 25-35%.

Taking into account the existing severe world-wide energy crisis it appears that the present invention represents an extremely important advance.

By way of non-limitative example there is described hereafter the application of an inventive economizer device for fully exploiting the thermal output of central heating installations, applied as a matter of example to an oil-fired hot water boiler with reference to the following description of the annexed drawings in which.

Figure 1:
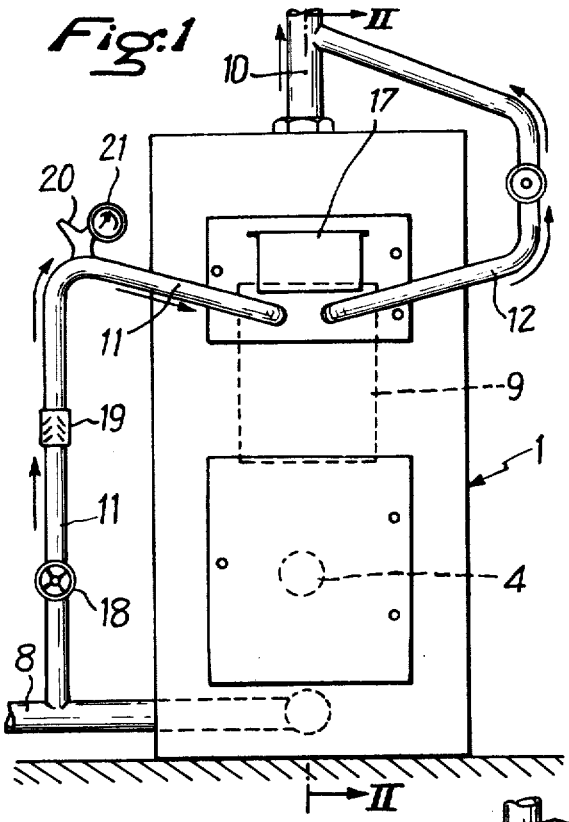
FIG. 1 is a front view of a boiler according to the invention.
Figure 2:
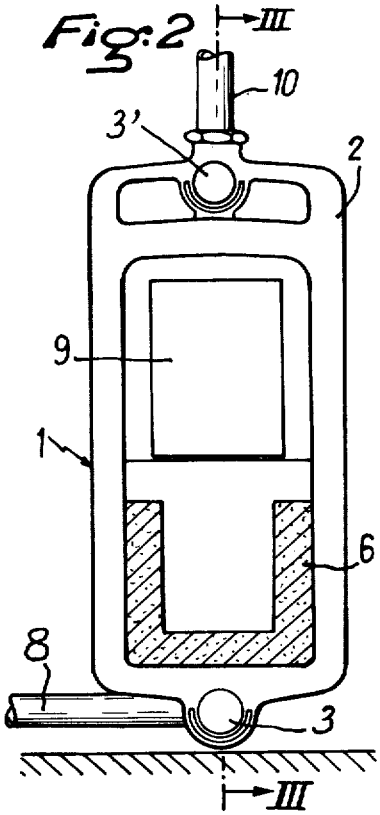
FIG. 2 is a vertical transverse section on the line II—II of FIG. 1.
Figure 3:
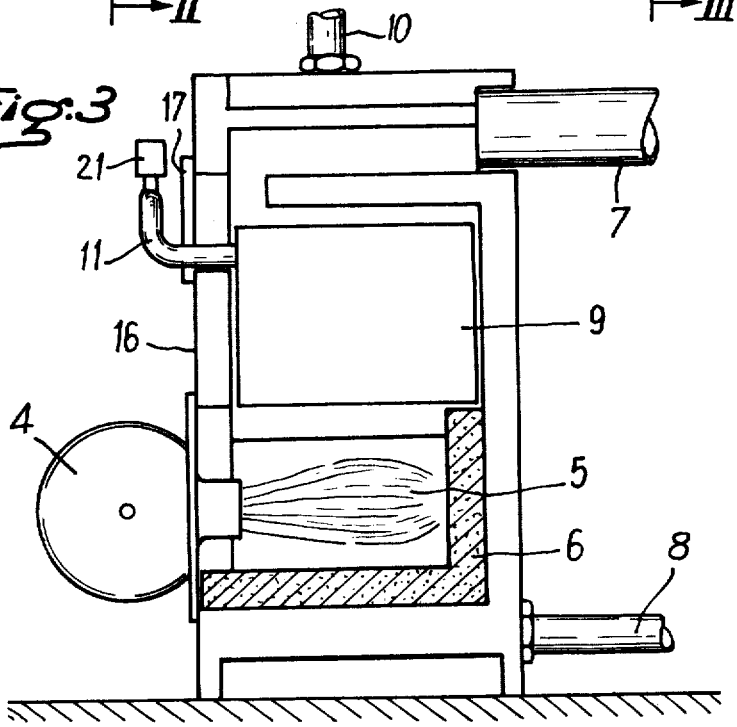
FIG. 3 is a vertical longitudinal section on the line III—III of FIG. 2.
Figure 4:
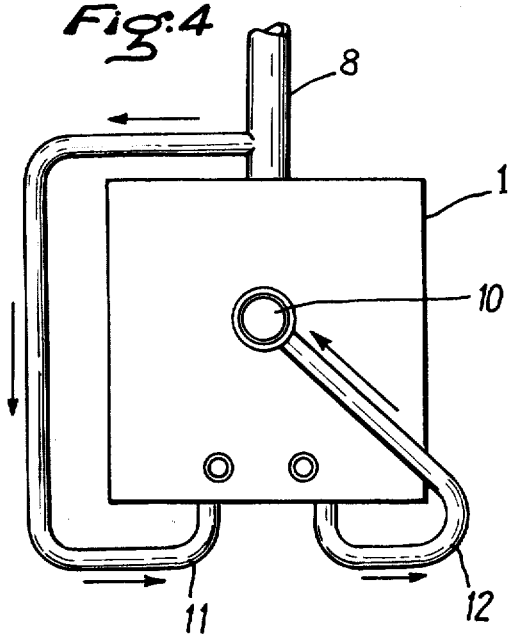
FIG. 4 is a plan view of the same boiler.

In the drawing, 1 indicates a hot water boiler constituted by elements such as 2 (see FIG. 2) interconnected by assembling nipples 3 and 3'. This boiler is fed by a burner 4 whereof the flame 5 is developed in an internal space giving rise to combustion gases which after traversing the upper part of the combustion chamber egress at 7. The boiler has a brickwork 6 surrounding the internal space that constitutes a combustion chamber. In the upper part of the chamber is disposed an economiser element or device 9 according to the invention. The fluid to be heated arrives by a pipe 8 and after being heated is fed towards the raditor by the boiler.

A branch tube or pipe 11 leads a fraction of the fluid to be heated into the economiser where it returns by a tube 12 to a principal conduit 10.

Figure 5:
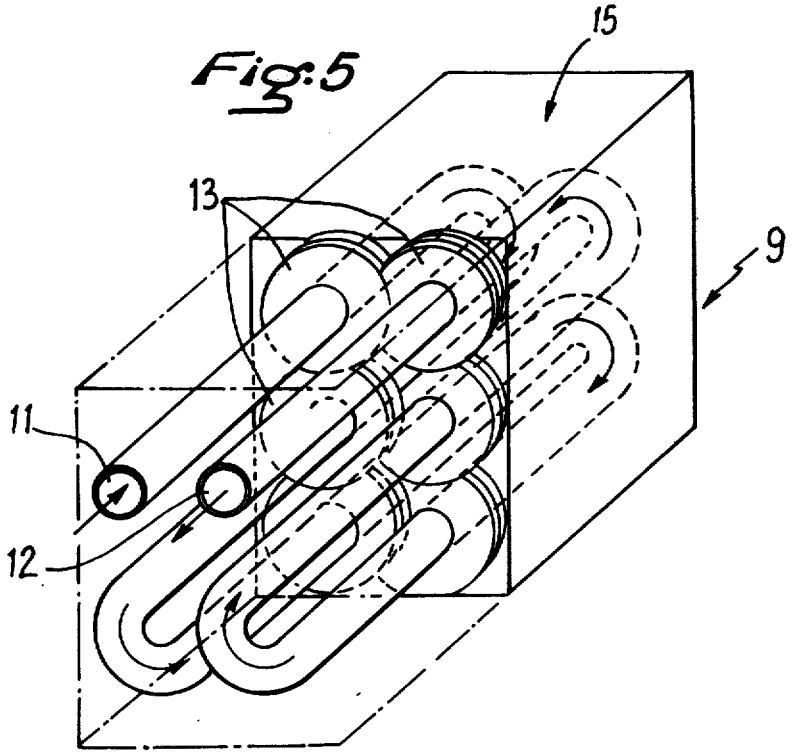
FIG. 5 is a schematic perspective view of the inventive economiser/ accumulator element adapted for the boiler shown in FIGS. 1 to 4.

The economiser device 9 is shown schematically in FIG. 5: it comprises a battery of finned tubes 13 connected together by elbows soldered preferably with autogenous solder. The assembly is coated with chamotte indicated by the general reference 15, this chamotte having the properties of resistance to high temperatures and the storage of heat, which it gives off ultimately after extinction of the burner.

The device 9 is supported by a vertical part of the combustion chamber brickwork 6 and by a door 16 of sheet steel coated with asbestos which permits the introduction and mounting of the device 9 as well as the tubes 11 and 12.

Above holes for the passage of these tubes is provided an anti-explosion valve 17 serving at the same time as a window for viewing the flame 5.

The inlet tube 11 of the economiser comprises an isolating valve 18, a one-way valve 19, an air cock 20 for completely eliminating air, and a safety valve 21 for ensuring the security of the battery of the economiser 9 in the case of accidental closure of the valve 8, which permits easy overhauling or disassembly of the economiser by draining away or cutting off the heat.

The functioning of the installation is as follows: The economiser 9 according to the invention being mounted in position in the boiler, the inlet and outlet tubes 11 and 12 respectively being connected to pipes 8 and 10 after filling the installation with water, the isolating valve 18 being open, the installation is rendered operative by adapting the nozzle of the burner 6 for example by replacing the normal nozzle of 0.75 that is to say 2.5 kilograms per hour of output by a nozzle of 0.50, namely 1.65 kilograms per hour of output.

After a few minutes of operation it can be noted that the economiser device heats more rapidly than the boiler circuit. On stoppage of the burner the outlet temperature of the economiser again increases relative to the outset so that the stoppage times of the burner are more spaced and longer than without the economiser. It can equally be noted that there is a very substantial decrease in the outlet temperature of the combustion gas.

The installation thus described can obviously function without an accelerator but such an apparatus is nevertheless desirable for it improves the output of the installation.

I claim:

1. An economizer device for fully exploiting the thermal output of central heating installations, the latter incorporating a boiler having water-circulation pipes between a cold-water feeding point and hot-water utilization points, employing both heating radiators and hot-water feeding devices of the type including: an adjustable heat source working intermittently and consisting of a sprayer for fuel oil, releasing hot combustion gases; a chamber disposed in proximity to said heat source for collecting said gases, said chamber being fitted with pipes within which latter water circulates and flows towards the utilization points; the economizer device being formed of a long nest of continuously connected gilled tubes disposed in said chamber for bypassing said water-circulation pipes; circulation water inlet and outlet pipes each respectively connected to associated inlet and outlet tubes of said gilled tubes for directing water into and out of said economizer; refractory material means encapsultating said tubes and filling the whole available volume of said chamber, in such a way that the most part of the thermal energy contained in the hot combustion gases, released by said sprayer is stored in said mass of said refractory material means before those gases leave said chamber then they are progressively transferred to the water flowing in said gilled tubes, so that this thermal energy is brought by the water flowing in said gilled tubes to the water flowing in said circulation pipes, leading to said utilization points, as a function of the consumption at these points, while said sprayer works with various outputs, after said sprayer has come to a total stoppage.

* * * * *